US010450935B2

(12) United States Patent
Ohn et al.

(10) Patent No.: US 10,450,935 B2
(45) Date of Patent: Oct. 22, 2019

(54) EXHAUST MANIFOLD AND METHOD OF COATING THE SAME

(71) Applicants: Hyundai Motor Company, Seoul (KR); Kia Motors Corporation, Seoul (KR)

(72) Inventors: Hyung Seuk Ohn, Seoul (KR); Woong Pyo Hong, Yongin-si (KR); Hong Kil Baek, Seoul (KR); Bo Kyung Kim, Yongin-si (KR); Se Hoon Park, Suwon-si (KR); Seung Woo Lee, Seoul (KR); Tae Jun Kang, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 53 days.

(21) Appl. No.: 15/683,482

(22) Filed: Aug. 22, 2017

(65) Prior Publication Data

US 2018/0128151 A1 May 10, 2018

(30) Foreign Application Priority Data

Nov. 9, 2016 (KR) ..... 10-2016-0148692

(51) Int. Cl.
*F01N 13/10* (2010.01)
*F01N 13/16* (2010.01)

(52) U.S. Cl.
CPC ..... *F01N 13/102* (2013.01); *F01N 13/16* (2013.01); *F01N 2310/00* (2013.01); *F01N 2510/02* (2013.01)

(58) Field of Classification Search
CPC .... F01N 13/102; F01N 13/16; F01N 2310/00; F01N 2510/02
See application file for complete search history.

(56) References Cited

U.S. PATENT DOCUMENTS 5,569,513 A * 10/1996 Fidler ..... C08J 9/0066 428/304.4
5,867,985 A * 2/1999 Furuhashi ..... F01N 13/008 60/323
2003/0091455 A1* 5/2003 Mathew ..... B22F 1/0059 419/8
2003/0106311 A1* 6/2003 Moore, III ..... B01D 53/945 60/323
2004/0177609 A1* 9/2004 Moore, III ..... B01D 53/945 60/323

(Continued)

FOREIGN PATENT DOCUMENTS

EP 1207081 A2 * 5/2002 ..... B60R 13/0815
JP 05171932 A * 7/1993

(Continued)

*Primary Examiner* — Laert Dounis
*Assistant Examiner* — Matthew T Largi
(74) *Attorney, Agent, or Firm* — Morgan, Lewis & Bockius LLP

(57) ABSTRACT

An exhaust manifold may include a main body provided with a plurality of branching passages communicating with a vehicle engine and provided with a single passage communicating with an exhaust canister, the branching passages merging with the single passage; and a coating layer coated on an internal surface of the main body forming the branching passages and the single passage, the coating layer including an aerogel.

4 Claims, 7 Drawing Sheets

(56) References Cited

U.S. PATENT DOCUMENTS

| | | | | |
|---|---|---|---|---|
| 2007/0238008 | A1* | 10/2007 | Hogan | B60R 13/08<br>219/458.1 |
| 2011/0000575 | A1* | 1/2011 | Ito | C23C 24/00<br>138/177 |
| 2015/0225630 | A1* | 8/2015 | Hosoi | C04B 26/06<br>428/403 |

FOREIGN PATENT DOCUMENTS

| | | | |
|---|---|---|---|
| JP | H05-171932 | A | 7/1993 |
| JP | 5081173 | B2 | 9/2012 |
| KR | 10-0727708 | B1 | 6/2007 |
| KR | 10-2014-0067137 | A | 6/2014 |
| KR | 10-1462755 | B1 | 11/2014 |
| KR | 10-2016-0070615 | A | 6/2016 |

* cited by examiner

EXHAUST MANIFOLD AND METHOD OF COATING THE SAME

CROSS-REFERENCE(S) TO RELATED APPLICATIONS

The present application claims priority to Korean Patent Application No. 10-2016-0148692, filed Nov. 9, 2016, the entire contents of which is incorporated herein for all purposes by this reference.

BACKGROUND OF THE INVENTION

Field of the Invention

The present invention relates to an exhaust manifold configured for improving fuel efficiency by reducing catalyst heating (CH) control time such that a heat loss of exhaust gas generated from an engine and transmitted to an exhaust pipe is minimized.

Description of Related Art

Generally, a three-way catalyst provided in a gasoline engine is configured to have a high efficiency in exhaust gas purification when a temperature of the catalyst is higher than a predetermined temperature (LOT: Light Off Time, 350° C.). In other words, before the three-way catalyst reaches LOT, hazardous exhaust gas discharged to the atmosphere is increased; and after the three-way catalyst reaches LOT, hazardous exhaust gas discharged to the atmosphere is decreased because purification efficiency of the three-way catalyst is high.

All vehicles using a gasoline engine, and HEV or PHEV vehicles are provided with the three-way catalyst, wherein LOT is reduced in such a way that ignition timing is delayed to increase exhaust gas temperature. However, in terms of efficiency, loss of exhaust gas is increased according to a delay of ignition timing, whereby the engine efficiency is lowered.

To reduce LOT, various methods have been developed for improving fuel efficiency and reducing the cost of catalyst material by reducing the catalyst heating (CH) control time. One of the methods is a method where an exhaust pipe, through which the exhaust gas is discharged, is configured to be a double exhaust pipe. Another method is a method where an insulator is provided outside the exhaust pipe.

In the case of the former method, a thermal insulation effect may be achieved, but the manufacturing cost may be high because of a complex structure. Further, to secure an exhaust pressure level, a diameter of an internal exhaust pipe should be designed corresponding to a level of a conventional single exhaust pipe, so when an external exhaust pipe is considered the entire diameter of the double exhaust pipe is increased compared to the conventional single exhaust pipe. Thereby, a problem relating to an engine compartment packaging efficiency may occur.

In the case of the latter method, when CH control time is long enough, the method may work, but in reality the CH control time is short, from approximately 25 to 35 seconds, whereby the method may not work sufficiently during the CH control time. In other words, during the CH control time, energy from the exhaust gas at a high temperature is transmitted to a catalyst while heating an exhaust pipe between the engine and the catalyst. Here, to reduce the CH control time, thermal energy used for heating the exhaust pipe between the engine and the catalyst should be minimized. However, since the insulator is provided outside the exhaust pipe, thermal energy transmitted to the exhaust pipe has little variation compared to the conventional exhaust pipe under the condition of a short CH control time, whereby it is difficult to reduce the CH control time.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an exhaust manifold configured for improving fuel efficiency by reducing a catalyst heating (CH) control time such that a heat loss of an exhaust gas generated from an engine and transmitted to an exhaust pipe is minimized.

According to various aspects of the present invention, there is provided an exhaust manifold including: a main body provided with a plurality of branching passages communicating with a vehicle engine, and provided with a single passage communicating with an exhaust canister, formed such that the branching passages merge with the single passage; and a coating layer coated on an internal surface of the main body forming the branching passages and the single passage, the coating layer including an aerogel.

The main body may include: an upper portion provided with a first curved surface on a bottom surface thereof by being curved upwardly at a location corresponding to a location where the branching passages and the single passage are provided, and provided with a first bonding surface between the plurality of the branching passages; and a lower portion provided with a second curved surface on a top surface thereof by being curved downwardly, forming the branching passages and the single passage by being coupled with the upper portion, and provided with a second bonding surface between the plurality of the branching passages to come into contact with the first bonding surface, wherein the coating layer is coated along the first curved surface and the second curved surface to have a predetermined thickness.

The coating layer may further include an additive for improving adhesion, wherein particles form the aerogel cluster on the internal surface of the main body.

The coating layer may be in a multilayer structure formed by repeatedly layering a plurality of layers including the particles and the additive, and air pores may exist between the particles.

The additive includes at least one of zirconium, zirconia, aluminum, silicon, and calcium.

The additive includes 60 to 80 wt % of zirconia and 20 to 40 wt % of silicon.

According to various aspects of the present invention, there is provided a method of coating an exhaust manifold, in which the exhaust manifold is provided with a plurality of branching passages communicating with a vehicle engine, and is provided with a single passage communicating with an exhaust canister, the branching passages merging with the single passage, the method including: a first coating step of forming a first coating layer having an aerogel on an internal surface of an upper portion of the exhaust manifold forming the branching passages and the single passage, the upper portion disposed at an upper portion of the exhaust manifold when the exhaust manifold is divided into two in a direction parallel with a longitudinal direction of the branching passages and the single passage; and a second coating step of forming a second coating layer having an aerogel on an internal surface of a lower portion of the exhaust manifold forming the branching passages and the single passage, the lower portion disposed at a lower portion of the exhaust manifold when the exhaust manifold is divided into two in the direction parallel with the longitudinal direction of the branching passages and the single passage.

In the first coating step, a first curved surface that forms the internal surface of the upper portion and is curved upwardly at a location corresponding to a location where the branching passages and the single passage are provided may be coated with the first coating layer to have a predetermined thickness. In the second coating step, a second curved surface that forms the internal surface of the lower portion and is curved downwardly to form the branching passages and the single passage by being coupled with the upper portion may be coated with the second coating layer to have a predetermined thickness.

The method may further include a preparation step before the first coating step, wherein particles that form the aerogel and additive that improves adhesion to allow the particles to cluster are prepared in powder form. The particles and the additive in powder form are mixed to prepare mixed powder, wherein in the first coating step and the second coating step, the mixed powder is melted into a plasma state by applying a current, and is then sprayed on the internal surfaces of the upper portion and the lower portion, forming the first coating layer and the second coating layer.

In the preparation step, the mixed powder may be controlled to have an average size ranging from 30 to 100 μm.

In the first coating step and the second coating step, the applied current may be controlled to be within a range of 470 to 500 A.

The first coating step may include a first forming step of forming a first layer including the particles and the additive by use of both particles forming the aerogel on the internal surface of the upper portion and additive improving adhesion to allow the particles to cluster. The second coating step may include a second forming step of forming a second layer including the particles and the additive by use of both particles forming the aerogel on the internal surface of the lower portion and additive improving adhesion to allow the particles to cluster. The first forming step and the second forming step may be performed repeatedly, wherein the first layer and the second layer are repeatedly formed to be a multilayer structure, having a predetermined thickness.

The first forming step or the second forming step may be performed to form the first layer or the second layer. After the first layer or the second layer is hardened, the first forming step or the second forming step may be performed again.

According to the exhaust manifold of the present invention as described above, it is possible to improve the fuel efficiency of a vehicle by reducing the catalyst heating (CH) control time such that the heat loss of the exhaust gas generated from an engine and transmitted to an exhaust pipe is minimized.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
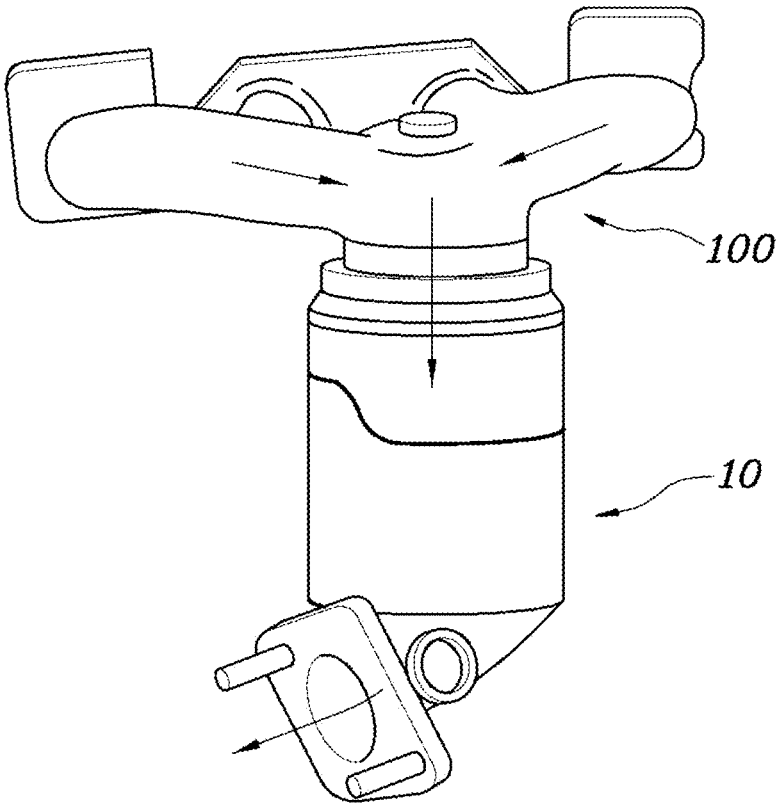
FIG. 1 is a view showing a main body communicating with an exhaust canister according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 2:
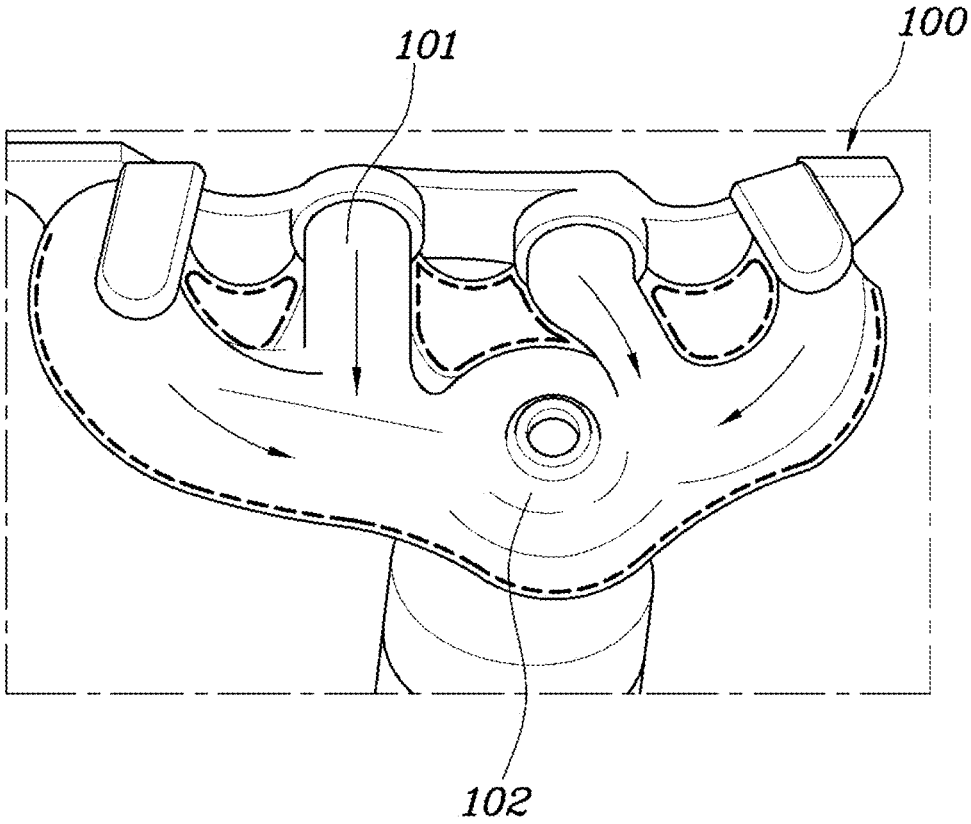
FIG. 2 is a view showing exhaust gas moving along branching passages and single passage of the main body according to the exemplary embodiment of the present invention by use of an arrow.
Figure 3:
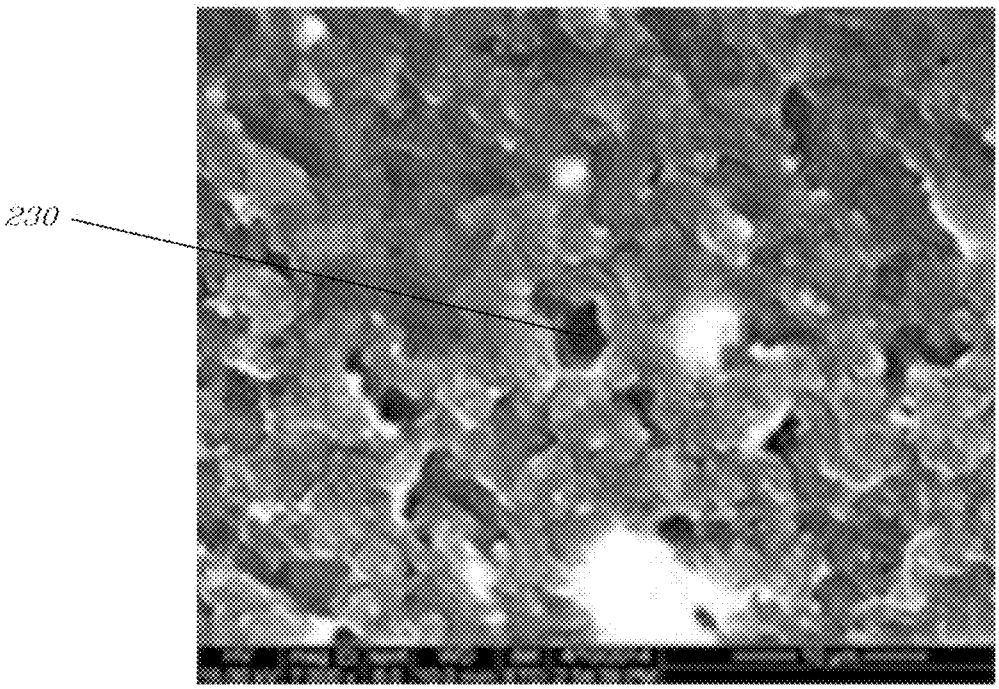
FIG. 3 is a photograph showing air pores by enlarging a coating layer according to the exemplary embodiment of the present invention.

Referring to FIG. 1 to FIG. 3, an exhaust manifold according to an exemplary embodiment of the present invention may include a main body 100 provided with a plurality of branching passages 101 communicating with a vehicle engine, and provided with a single passage 102 communicating with an exhaust canister 10, the branching passages 101 merging with the single passage 102; and a coating layer 200 coated on an internal surface of the main body 100 forming the branching passages 101 and the single passage 102, the coating layer including an aerogel.

The main body 100 is formed with the single passage 102 where the branching passages 101 merge. The branching passages 101 communicate with the vehicle engine to allow an exhaust gas generated from the engine to move. Since the single passage 102 communicates with the exhaust canister 10, the exhaust gas from the engine moves along the single passage 102 via the branching passages 101, and then moves to the exhaust canister 10.

The coating layer 200 is formed in a coated form along the internal surface of the main body 100 that is formed with the branching passages 101 and the single passage 102 where the exhaust gas moves. The coating layer 200 includes an aerogel that is a new material with a good thermal insulation effect. The present thermal insulation effect results from an air layer formed by properties of the aerogel.

Preferably, since it is hard to dispose the aerogel to the surfaces of the branching passages 101 and the single passage 102, the aerogel may be coated on the internal surface of the main body 100 by being mixed with additive 220 that improves adhesion.

The coating layer 200 including the aerogel is coated primarily for improving an insulation performance. As described above, the coating layer 200 is formed along the branching passages 101 and the single passage 102, which are routes for the exhaust gas, providing a thermal insulation effect better than a case where a material performing the insulation function is provided external to the main body 100. The present case is because the coating layer 200 coated on the internal surface prevents heat from being conducted to the main body 100.

Figure 4:
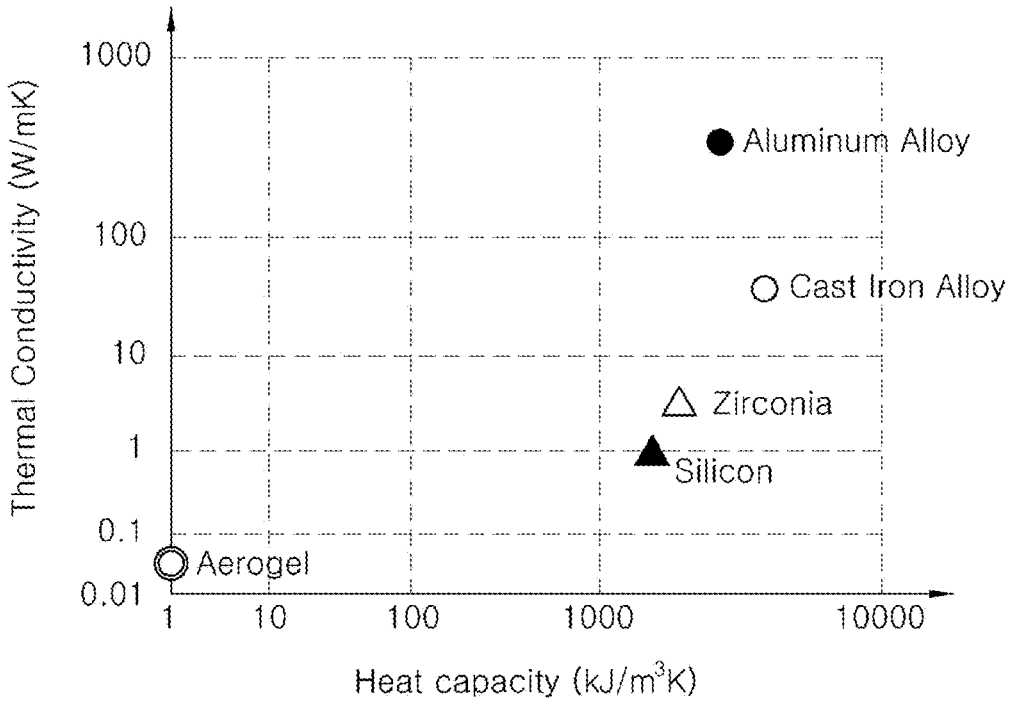
FIG. 4 is a graph showing thermal conductivity for heat capacity of various materials including an aerogel according to the exemplary embodiment of the present invention.

As shown in a graph of FIG. 4, the aerogel has a thermal conductivity lower than other materials, whereby it is possible to minimize heat loss of the exhaust gas passing through the exhaust manifold according to an exemplary embodiment of the present invention by maximally preventing heat transmitted from the exhaust gas from being conducted to the main body 100 via the coating layer 200.

Further, as shown in the graph of FIG. 4, since the aerogel has a low heat capacity, an absolute amount of heat absorbed from the exhaust gas is small, whereby it is possible to minimize heat loss of the exhaust gas passing through the exhaust manifold according to an exemplary embodiment of the present invention.

Based on the above mentioned reasons, it is possible to move the exhaust gas with minimal heat loss to a three-way catalyst provided inside the exhaust canister 10. Accordingly, it is possible to increase the energy transmitted to the three-way catalyst, and accordingly it is possible to reduce the catalyst heating (CH) control time.

By reducing the CH control time, it is possible to improve the fuel efficiency of a vehicle, and is possible to reduce the cost of the catalyst material.

An aerogel is a mesoporous nanostructure that is derived from gels—effectively the solid structure of a gel, only with gas in its pores instead of liquid. The aerogel includes nano-particles ranging from 1 to 50 nm in diameter and has a mesoporous structure, h, having an excellent insulation performance.

Figure 5:
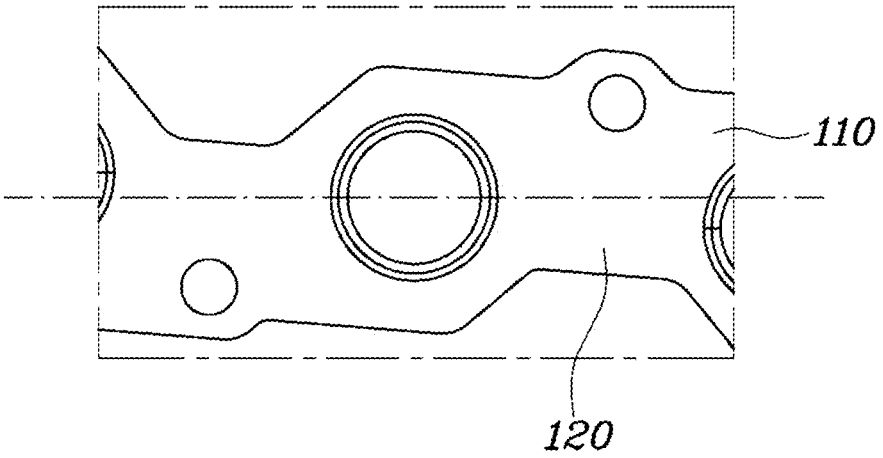
FIG. 5 is a view showing an upper portion and a lower portion according to the exemplary embodiment of the present invention.
Figure 6:
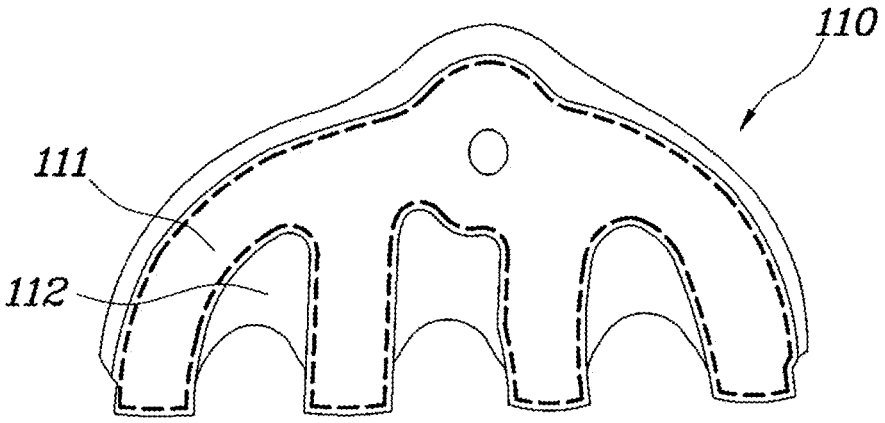
FIG. 6 is a view showing the upper portion formed with a first curved surface and a first bonding surface according to the exemplary embodiment of the present invention.
Figure 7:
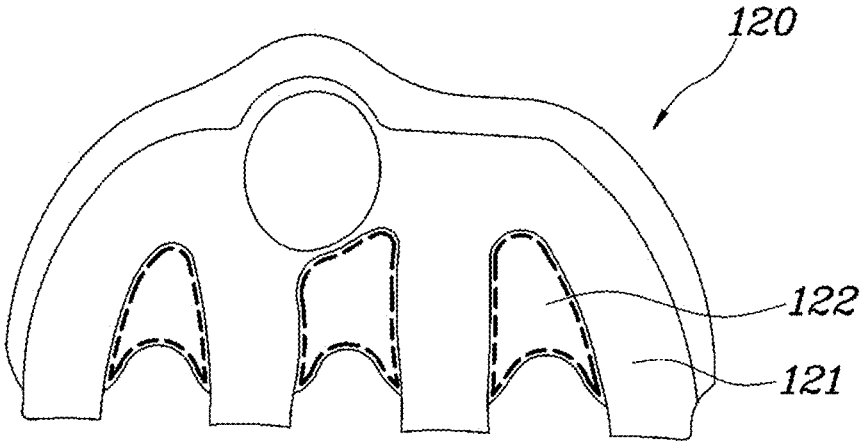
FIG. 7 is a view showing the lower portion formed with a second curved surface and a second bonding surface according to the exemplary embodiment of the present invention.

Referring to FIG. 5 to FIG. 7, the main body 100 may include an upper portion 110 provided with a first curved surface 111 on a bottom surface thereof by being curved upwardly at a location corresponding to a location where the branching passages 101 and the single passage 102 are provided, and provided with a first bonding surface 112 between the plurality of the branching passages 101; and a lower portion 120 provided with a second curved surface 121 on a top surface thereof by being curved downwardly, forming the branching passages 101 and the single passage 102 by being coupled with the upper portion 110, and provided with a second bonding surface 122 between the plurality of the branching passages 101 to come into contact with the first bonding surface 112, wherein the coating layer 200 is coated along the first curved surface 111 and the second curved surface 121 to have a predetermined thickness D.

The upper portion 110 defines an upper portion of the main body 100 when the main body 100 is divided into two in a direction parallel with a longitudinal direction of the branching passages 101 and the single passage 102. The upper portion 110 is formed with the first curved surface 111 curved upwardly from the internal surface of the main body 100, wherein top surfaces of the branching passages 101 and the single passage 102 are formed.

The first bonding surface 112 is formed between each of the branching passages 101. Since the first curved surface 111 is curved upwardly, the first bonding surface may be flat.

The lower portion 120 defines a lower portion of the main body 100 when the main body 100 is divided into two in a direction parallel with a longitudinal direction of the branching passages 101 and the single passage 102. The lower portion 120 is formed with the second curved surface 121 curved downwardly from the internal surface of the main body 100, wherein bottom surfaces of the branching passages 101 and the single passage 102 are formed.

The second bonding surface 122 is formed between each of the branching passages 101. Since the first curved surface 111 is curved upwardly, the second bonding surface may be flat.

The upper portion 110 formed with the first curved surface 111 and the first bonding surface 112, and the lower portion 120 formed with the second curved surface 121 and the second bonding surface 122 are coupled to form the main body 100. The branching passages 101 and the single passage 102 are provided by forming the first curved surface 111 and the second curved surface 121, and a sufficient area for allowing the upper portion 110 and the lower portion 120 to be coupled to each other is provided by forming the first bonding surface 112 and the second bonding surface 122.

As shown in FIG. 5, based on a virtual horizontal line shown as an alternating long and short dash line, the upper portion 110 and the lower portion 120 may be divided into two.

As a part that is shown as a dotted line of FIG. 2, a portion, where the first bonding surface 112 and the second bonding surface 122 are bonded to each other, and edge portions of the upper portion 110 and the lower portion 120 are welded to each other, wherein the upper portion 110 and the lower portion 120 are securely bonded to each other.

Meanwhile, the coating layer 200 including the aerogel is coated along the first curved surface 111 and the second curved surface 121 to have a predetermined thickness D, whereby it is possible to improve a thermal insulation effect. Herein, the predetermined thickness D may range from 1.5 to 2.4 mm.

The coating layer 200 further includes additive 220 for improving adhesion, wherein particles 210 forming the aerogel cluster on the internal surface of the main body 100.

As described above, since the particles 210 of the aerogel are light, to form the coating layer 200 on the internal surface of the main body 100, the additive 220 improving adhesion may be mixed with the particles. As the additive 220, poly-amide-imide (PAI), which is a high molecular substance, may be used, but a ceramic material with an excellent heat resistance may be used accordingly. For example, ceramic materials, including zirconium (Zr), aluminum (Al), silicon (Si), and calcium (Ca), may be used.

A main ingredient of the aerogel and a ceramic material constituting the additive 220 are mixed with each other in a room temperature condition in powder form. The mixed powder is melted into a plasma state, then sprayed on the internal surface of the main body 100, forming the coating layer 200 through a thermal spray coating method.

To be more specific, the mixed powder melted into a plasma state is sprayed on the first curved surface 111 of the upper portion 110, and the second curved surface 121 of the lower portion 120, forming the coating layer 200.

Figure 8:
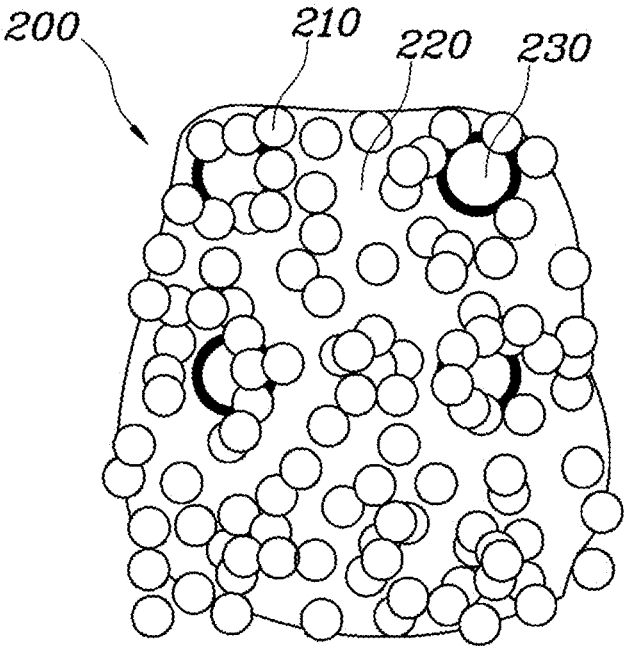
FIG. 8 is a view showing the coating layer according to the exemplary embodiment of the present invention.
Figure 9:
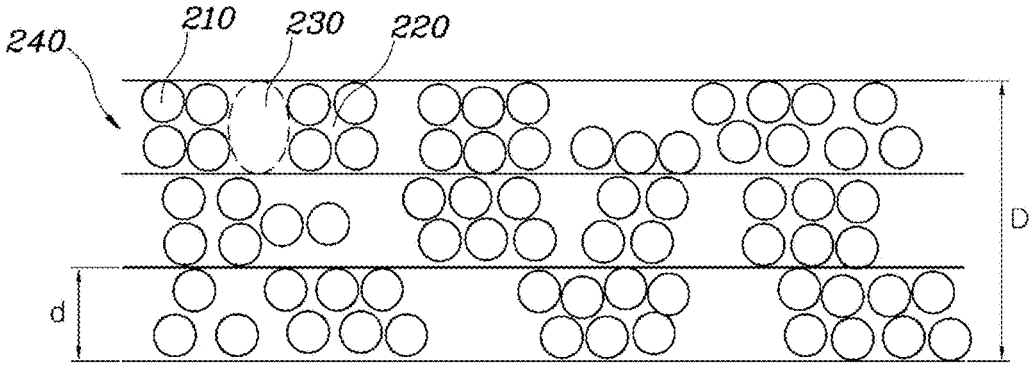
FIG. 9 is a view showing the coating layer including a plurality of layers according to the exemplary embodiment of the present invention.

Referring to FIG. 8 and FIG. 9, the coating layer 200 is in a multilayer structure formed by repeatedly layering a plurality of layers 240 including the particles 210 and the additive 220, and air pores 230 exist between the particles 210.

The coating layer 200 is in a multilayer structure where a plurality of layers 240 including the particles 210 and the additive 220 is layered repeatedly, and may be formed on the internal surface of the main body 100. Further, the air pores 230 exist between the particles 210 mixed with the additive 220, so a layer of the air pores 230 are formed on the coating layer 200, whereby it is possible to improve the heat resistance. A cross-section of each of the air pores 230 may be in an annular shape.

When the coating layer 200 is coated on the internal surface of the main body 100, one layer 240 is formed by spraying the mixed powder melted into a plasma state on the first curved surface 111 of the upper portion 110 and the second curved surface 121 of the lower portion 120. After the one layer 240 is layered and hardened, another layer 240 is formed by spraying the mixed powder melted into a plasma state on the first curved surface 111 of the upper portion 110 and the second curved surface 121 of the lower portion 120.

By repeating the above process, it is possible to form the coating layer 200, where a plurality of layers 240 is layered to form a multilayer structure. By forming the multilayer structure including a plurality of layers 240 rather than forming the coating layer 200 constituting a single layer, it is possible to form many air pores 230, whereby it is possible to improve the thermal insulation effect.

A thickness d of the layer 240 may range from 100 to 40000 nm.

The additive 220 includes at least one of zirconium, zirconia, aluminum, silicon, and calcium.

As described above, the additive 220 may include zirconia ($ZrO_2$) and silicon, wherein since zirconia has a better heat resistance than PAI, and silicon has a better warm-up performance than PAI. Zirconia and silicon are included in the additive 220.

Preferably, based on the entire weight of the additive 220, zirconia may account for 60 to 80 wt %, and silicon may account for 20 to 40 wt %. When zirconia accounts for less than 60 wt %, heat resistance may be lowered, and when silicon accounts for less than 20 wt %, warm-up performance may be lowered.

Further, the additive includes PAI, other than zirconia and silicon. Since PAI is formed in a powder form, it is used for coating metal or magnetic wire, and may be used by being mixed with other additives depending on the intended usage. PAI varnish is used to give a decorative effect and to prevent corrosion, along with fluoropolymer. PAI is configured to bond fluoropolymer onto a metal substrate.

A method of coating an exhaust manifold according to an exemplary embodiment of the present invention, in which the exhaust manifold is provided with a plurality of branching passages 101 communicating with a vehicle engine and is provided with a single passage 102 communicating with an exhaust canister 10, the branching passages 101 merging with the single passage 102, may include a first coating step of forming a first coating layer having an aerogel on an internal surface of an upper portion 110 of the exhaust manifold forming the branching passages 101 and the single passage 102, the upper portion 110 disposed at an upper portion of the exhaust manifold when the exhaust manifold is divided into two in a direction parallel with a longitudinal direction of the branching passages 101 and the single passage 102; and a second coating step of forming a second coating layer having an aerogel on an internal surface of a lower portion 120 of the exhaust manifold forming the branching passages 101 and the single passage 102, the lower portion 120 disposed at a lower portion of the exhaust manifold when the exhaust manifold is divided into two in the direction parallel with the longitudinal direction of the branching passages 101 and the single passage 102.

In the first coating step, the first coating layer including an aerogel is formed on the internal surface of the upper portion 110 to improve the insulation performance. The first coating layer includes a material having an aerogel that is a new material with a good thermal insulation effect. The present good thermal insulation effect results from an air layer formed by properties of the aerogel. Preferably, since it is hard to fix the aerogel to the surfaces of the branching passages 101 and the single passage 102, the aerogel is coated on the internal surface of the upper portion 110 by being mixed with additive 220 that improves adhesion.

In the second coating step, the second coating layer including an aerogel is formed on the internal surface of the lower portion 120 to improve the insulation performance. Like the first coating layer, the second coating layer includes a material having an aerogel that is a new material with a good thermal insulation effect. Preferably, since it is hard to fix the aerogel to the surfaces of the branching passages 101 and the single passage 102, the aerogel is coated on the internal surface of the lower portion 120 by being mixed with additive 220 that improves adhesion.

The first coating step and the second coating step may be performed simultaneously, or sequentially. After the first coating layer and the second coating layer are formed through the first coating step and the second coating step, the exhaust manifold can be made by coupling the upper portion 110 with the lower portion 120. In a process of coupling the upper portion 110 with the lower portion 120, welding may be used. Preferably, bonding surfaces are formed in the upper portion 110 and the lower portion 120 to allow welding.

Preferably, in the first coating step, a first curved surface 111 that forms the internal surface of the upper portion 110 and is curved upwardly at a location corresponding to a location where the branching passages 101 and the single passage 102 are provided is coated with the first coating layer to have a predetermined thickness D. In the second coating step, a second curved surface 121 that forms the internal surface of the lower portion 120 and is curved downwardly to form the branching passages 101 and the single passage 102 by being coupled with the upper portion 110 is coated with the second coating layer to have a predetermined thickness D.

The upper portion 110 is formed with the first curved surface 111 curved upwardly from the internal surface thereof, wherein the top surfaces of the branching passages 101 and the single passage 102 are formed. Further, the first bonding surface 112 is formed between each of the branching passages 101 of the first curved surface 111. Since the first curved surface 111 is curved upwardly, the first bonding surface may be flat.

The lower portion 120 is formed with the second curved surface 121 curved downwardly from the internal surface thereof, wherein bottom surfaces of the branching passages 101 and the single passage 102 are formed. Further, the second bonding surface 122 is formed between each of the branching passages 101 of the second curved surface 121. Since the first curved surface 111 is curved upwardly, the second bonding surface may be flat.

The first coating layer and the second coating layer, which include a material including the aerogel that improves heat resistance performance, are respectively coated along on the first curved surface 111 and the second curved surface 121, to have a predetermined thickness D.

Preferably, in the first coating step, to selectively form the first coating layer on the first curved surface 111, a masking process is performed at a portion of the internal surface of the upper portion 110, which is a portion except the first curved surface 111, including the first bonding surface 112, and then the first coating layer is formed only on the first curved surface 111 through spraying. Alternatively, after the entire internal surface of the upper portion 110 may be coated, coating may be removed from a portion except the first curved surface 111, whereby the first coating layer may be formed only on the first curved surface 111.

Further, just like the first coating step, in the second coating step, to selectively form the second coating layer on the second curved surface 121, a masking process may be performed at a portion of the internal surface of the lower portion 120, which is a portion except the second curved surface 121, including the second bonding surface 122, and then the second coating layer may be formed only on the second curved surface 121 through spraying. Alternatively, after the entire internal surface of the lower portion 120 may be coated, coating may be removed from a portion except the second curved surface 121, whereby the second coating layer may be formed only on the second curved surface 121.

The method further includes a preparation step before the first coating step, wherein particles 210 that form the aerogel, and additive 220 that improves adhesion to allow the particles 210 to cluster are prepared in powder form. The particles 210 and the additive 220 in powder form are mixed to prepare a mixed powder, wherein in the first coating step and the second coating step, the mixed powder is melted into a plasma state by applying a current, and then sprayed on the internal surfaces of the upper portion 110 and the lower portion 120, forming the first coating layer and the second coating layer.

As a method for forming the first coating layer and the second coating layer, the aerogel particles 210 and the additive 220 may be prepared in powder form, and the mixed powder in powder form may be sprayed onto the internal surfaces of the upper portion 110 and the lower portion 120. Further, as another method, there is the thermal spray coating method where the mixed powder in powder form is melted into a plasma state by heating and then is sprayed onto the internal surfaces of the upper portion 110 and the lower portion 120.

To improve heat resistance performance of the first coating layer and the second coating layer, the air pores 230 are formed therein, so the thermal spray coating method may be used to form the first coating layer and the second coating layer because the method facilitates forming the air pores 230. Further, in the case of using the thermal spray coating method, it is advantageous in that durability and heat resistance thereof is better than the spray method.

Before the first coating step and the second coating step, in the preparation step, the aerogel particles 210 and the additive 220 may be mixed to prepare mixed powder. After the mixed powder is prepared through the preparation step, in the first coating step and the second coating step, a current is applied to the mixed powder to raise the temperature of the powder into a high temperature state, and then the mixed powder is melted into a plasma state at a temperature higher than 10000 K.

When the mixed powder is melted into a plasma state, the melted mixed powder is sprayed onto the internal surfaces of the upper portion 110 and the lower portion 120, forming the first coating layer and the second coating layer.

Preferably, in the preparation step, the mixed powder is controlled to have an average size ranging from 30 to 100 μm.

The mixed powder prepared through the preparation step is controlled to have an average size ranging from 30 to 100 μm. When the average size is less than 30 μm in a process of applying the thermal spray coating method, all of the mixed powder may be melted by the high temperature caused by the current, so it is impossible to form the air pores 230, losing thermal properties. On the contrary, when the average size is more than 100 μm in a process of applying the thermal spray coating method, excessive mixed powder that is not melted into a plasma state by the high temperature caused by the current exists, so adhesion of the coating layer 200 may be weakened. Accordingly, the coating layer may be separated from the internal surfaces of the upper portion 110 and the lower portion 120.

Accordingly, in the preparation step, the mixed powder has an average size ranging from 30 to 100 μm.

Preferably, in the first coating step and the second coating step, the applied current is controlled to be within a range of 470 to 500 A.

When the current applied in the first coating step and the second coating step is less than 470 A, the mixed powder is not sufficiently melted so a temperature of the plasma may be low. Accordingly, adhesion of the coating layer 200 may be weakened, and the coating layer may be separated from the internal surfaces of the upper portion 110 and the lower portion 120. On the contrary, when the current applied in the first coating step and the second coating step is more than 500 A, all the mixed powder may be melted by high temperature caused by the current so it is impossible to form the air pores 230, losing thermal properties.

Accordingly, in the first coating step and the second coating step, the applied is controlled to be within a range of 470 to 500 A.

The first coating step includes a first forming step of forming a first layer including the particles 210 and the additive 220 by use of both particles 210 forming the aerogel on the internal surface of the upper portion 110 and additive 220 improving adhesion to allow the particles 210 to cluster; and the second coating step includes a second forming step of forming a second layer including the particles 210 and the additive 220 by use of both particles 210 forming the aerogel on the internal surface of the lower portion 120 and additive 220 improving adhesion to allow the particles 210 to cluster, wherein the first forming step and the second forming step are performed repeatedly, so that the first layer and the second layer are repeatedly formed to be a multilayer structure having a predetermined thickness D.

In the first forming step, the first layer 240 that includes the aerogel particles 210 and the additive 220, and preferably, is formed with the air pores 230 between the aerogel particles 210, is formed on the internal surface of the upper portion 110. Further, just like the first forming step, in the second forming step, the second layer 240 that includes the aerogel particles 210 and the additive 220, and preferably, is formed with the air pores 230 between the aerogel particles 210 is, formed on the internal surface of the lower portion 120.

The first forming step and the second forming step are performed repeatedly, wherein the first forming step and the second forming step are performed repeatedly until the first coating layer and the second coating layer have a predetermined thickness D. Accordingly, the first coating layer 200 may be formed in a multilayer structure where a plurality of first layers is layered repeatedly, and the second coating layer 200 may be formed in a multilayer structure where a plurality of second layers are layered repeatedly.

By forming the first coating layer and second coating layer into a multilayer structure rather than a single layer, it is possible to increase a percentage of the air pores 230 existing in the first coating layer and the second coating layer. Accordingly, it is possible to improve the insulation performance of the first coating layer and the second coating layer.

The first forming step or the second forming step is performed to form the first layer or the second layer, and after the first layer or the second layer is hardened, the first forming step or the second forming step is performed again.

By performing the first forming step or the second forming step, the first layer or the second layer is formed on the internal surface of the upper portion 110 or on the internal surface of the lower portion 120. The first forming step or the second forming step is not performed right after the first layer or the second layer is formed. Instead, the first forming step or the second forming step is performed again when the first layer or the second layer is completely hardened for 2 to 3 minutes at a room temperature.

Accordingly, it is possible to prevent other layers layered on top of the first layer or the second layer from pressing the first layer or the second layer, and it is possible to prevent the air pores 230 of the first layer or the second layer from being decreased when heat from other layers layered on top of the first layer or the second layer is transmitted to the first layer or the second layer.

For convenience in explanation and accurate definition in the appended claims, the terms "upper", "lower", "internal", "outer", "up", "down", "upwards", "downwards", "front", "rear", "back", "inside", "outside", "inwardly", "outwardly", "internal", "external", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An exhaust manifold comprising:

a main body provided with a plurality of branching passages communicating with a vehicle engine, and provided with a single passage communicating with an exhaust canister, the plurality of branching passages merging with the single passage; and a coating layer coated on an internal surface of the main body forming the plurality of branching passages and the single passage, the coating layer including an aerogel; wherein the coating layer further includes an additive to improve adhesion, wherein particles form an aerogel cluster on the internal surface of the main body; and wherein the additive includes 60 to 80 wt % of zirconia and 20 to 40 wt % of silicon.

2. The exhaust manifold of claim 1, wherein the main body includes:

an upper portion provided with a first curved surface on a bottom surface thereof by being curved upwardly at a location corresponding to a location where the plurality of branching passages and the single passage are provided, and provided with a first bonding surface between the plurality of the branching passages; and a lower portion provided with a second curved surface on a top surface thereof by being curved downwardly, forming the plurality of branching passages and the single passage by being coupled with the upper portion, and provided with a second bonding surface between the plurality of the branching passages to contact with the first bonding surface, wherein the coating layer is coated along the first curved surface and the second curved surface to have a predetermined thickness.

3. The exhaust manifold of claim 1, wherein the coating layer is in a multilayer structure formed by repeatedly layering a plurality of layers including the particles and the additive, and air pores exist between the particles.

4. The exhaust manifold of claim 1, wherein the additive further includes at least one of zirconium, aluminum, and calcium.

* * * * *